United States Patent [19]

Mineck

[11] 4,217,791

[45] Aug. 19, 1980

[54] INSTANT ON-OFF THROTTLE ADJUSTMENT FOR INTERNAL COMBUSTION ENGINE DRIVEN VEHICLES

[75] Inventor: Fred Mineck, Phoenix, Ariz.

[73] Assignees: Warren F. B. Lindsley, Phoenix; Lee D. Uto, Winkelman, both of Ariz. ; part interest to each

[21] Appl. No.: 941,915

[22] Filed: Sep. 13, 1978

[51] Int. Cl.[2] ..... G05G 11/00

[52] U.S. Cl. ..... 74/482; 74/491; 74/501 R; 74/533

[58] Field of Search ..... 74/481, 482, 479, 491, 74/501 R, 523, 533; 192/3 T

[56] References Cited

U.S. PATENT DOCUMENTS

| | | | |
|---|---|---|---|
| 521,252 | 6/1894 | Anderson | 74/533 |
| 2,818,747 | 1/1958 | Rich | 74/482 |
| 2,979,172 | 4/1961 | Eshbaugh et al. | 74/482 X |
| 3,053,111 | 9/1962 | Amrein | 74/533 |
| 3,369,637 | 2/1968 | Anderson | 192/3 T |

*Primary Examiner*—Allan D. Herrmann
*Attorney, Agent, or Firm*—Warren F. B. Lindsley

[57] ABSTRACT

A dashboard operable on an off position control for throttles of internal combustion driven vehicles.

9 Claims, 13 Drawing Figures

INSTANT ON-OFF THROTTLE ADJUSTMENT FOR INTERNAL COMBUSTION ENGINE DRIVEN VEHICLES

BACKGROUND OF THE INVENTION

With the advent of smaller automobiles, trucks and the like which are driven by low horsepower internal combustion engines, the additional air conditioner compressor loads at idle speeds of the engines many times causes the engines to stop or idle roughly if the engine is adjusted for gasoline conservation. In order to conserve gasoline by setting the engine to idle at a low engine speed but at the same time to be able to easily temporarily increase the idle speed of the engine when needed such as at idle speeds when the air conditioner of the vehicle is on, or in cold weather when a higher idle speed is necessary to maintain the engine running, a new dashboard easy idle adjustment is needed.

SUMMARY OF THE INVENTION

In accordance with the invention claimed, a new and improved hand operated, dashboard mountable, quick setting, on-off throttle adjustment is provided.

It is, therefore, an object of this invention to provide a new and improved on-off throttle position control.

Another object of this invention is to provide a new and improved dashboard throttle control for vehicles driven by internal combustion engines which may be quickly operable to temporarily adjust the throttle of the vehicle and to sequentially quickly return the throttle to its initial setting.

A further object of this invention is to provide a new and improved dashboard operable throttle control which embodies a vernier adjustment.

A still further object of this invention is to provide an improved dashboard mountable throttle adjustment which is intended to be periodically operable by the driver of the vehicle.

A still further object of this invention is to provide an inexpensively manufacturable, easily mountable throttle control which may be readily attached to the carburetor cable speed control requiring no changes to the vehicles manufactured throttle control.

Further objects and advantages of the invention will become apparent as the description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
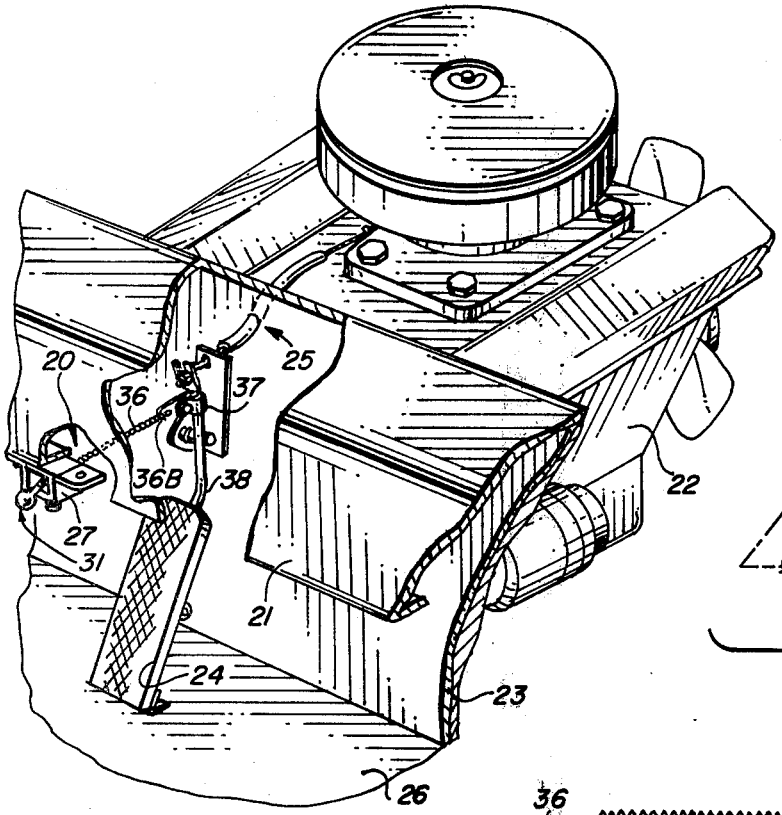
FIG. 1 is a perspective view of a dashboard mountable throttle control for the associated internal combustion engine and embodying the invention.

Referring more particularly to the drawing by characters of reference, FIGS. 1–6 disclose a throttle control 20 mounted on a dashboard 21 in the driver's compartment of a vehicle partially shown in FIG. 1 and comprising an internal combustion engine 22, firewall 23, an acceleration or gasoline peddle 24, carburetor lever mechanism 25 and floor 26 diagrammatically shown for purposes of illustration.

Figure 2:
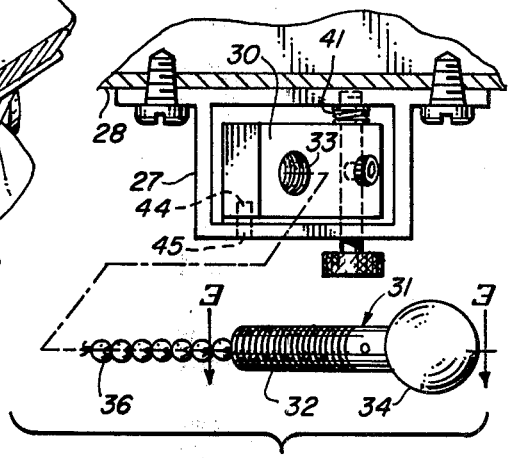
FIG. 2 is an exploded view showing one way of mounting the throttle control to the dashboard.
Figure 3:
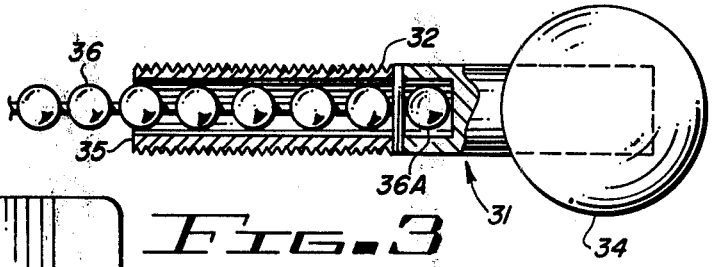
FIG. 3 is a cross-sectional view of FIG. 2 taken along the line 3—3.

As shown in FIGS. 1–6, the throttle control disclosed comprises a frame 27 suitably attached to the dashboard 21 of the vehicle and shown in FIGS. 1 and 2 as being attached, for example, to the bottom edge 28 of the dashboard. It should be recognized that the disclosed throttle control can be suitably mounted any place in the driver's compartment of the vehicle easily operable by him and thus fall within the scope of this invention.

On frame 27 is pivotally mounted a lever or latch means 29 comprising a plate 30 having an arm 31 extending laterally therefrom. Arm 31 comprises a shaft 32 which is attached in a threaded manner to an aperture 33 extending through plate 30. The end 34 of shaft 32 facing the driver of the vehicle may be knurled or rounded in form as shown to aid him in gripping and obtaining a five vernier adjustment of the throttle and carburetor if he so desires. The other end 35 of arm 31 or someplace along its length is attached to a suitable flexible elongated member such as, for example, a flexible ball chain 36 which is attached at one end 36A to the end 35 of arm 31 of the throttle control 20 and at its other end 36B to a suitable clamp 37 which is arranged to engage the shaft 38 of the known gas peddle 24 as clearly shown in FIG. 1.

Thus, by the threaded adjustment of shaft 32 in the threaded opening 33 the gas peddle 24 may be adjusted to increase or decrease the idle speed of the associated engine 22. By moving arm 29 counterclockwise as shown in FIGS. 1 and 2 the shaft 38 is pulled toward the driver or dashboard thereby opening the throttle causing the engine to idle at a faster rate of speed.

Figure 4:
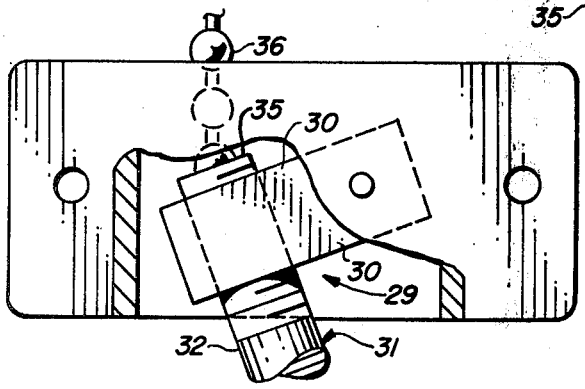
FIG. 4 is a partial top view of the throttle control showing it in position for increasing the throttle opening.
Figure 5:
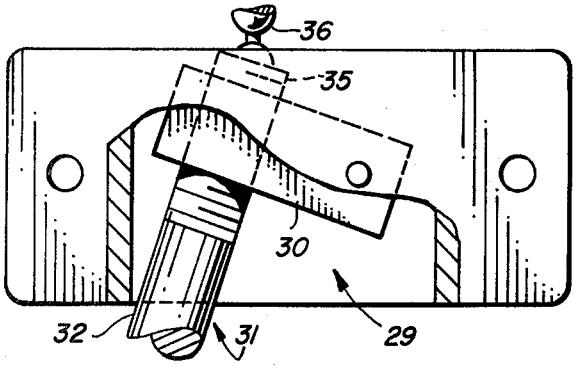
FIG. 5 is a partial top view similar to FIG. 4 showing the throttle control in its other released position having no effect on the normal throttle setting.
Figure 6:
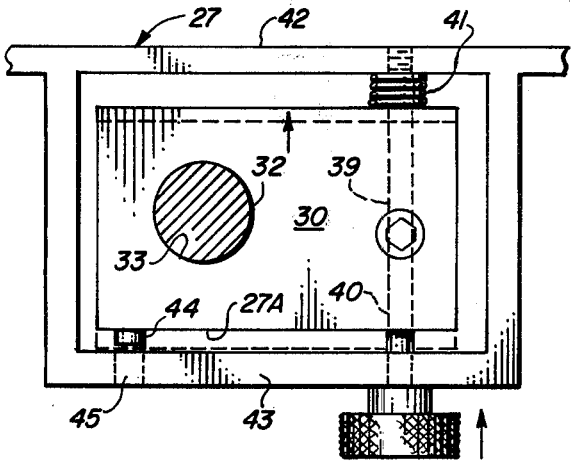
FIG. 6 is a front view of the throttle control shown in FIGS. 1 and 2 showing the throttle control spring biased release pin in its locked position.
Figure 7:
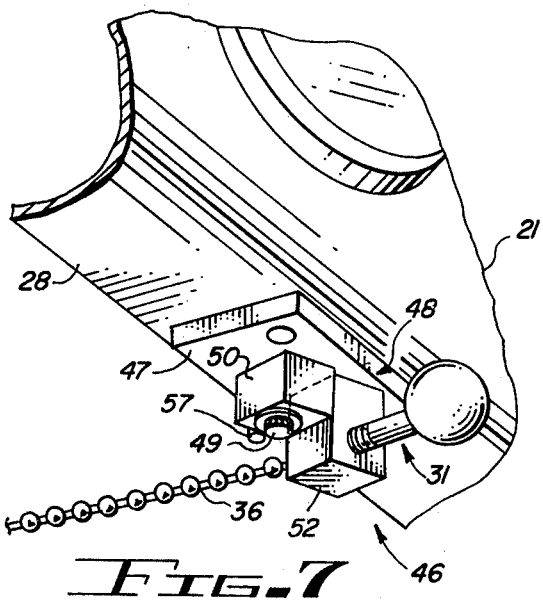
FIG. 7 is a perspective view of a modification of the throttle control shown in FIGS. 1–6 mounted on the dashboard of a vehicle.
Figure 8:
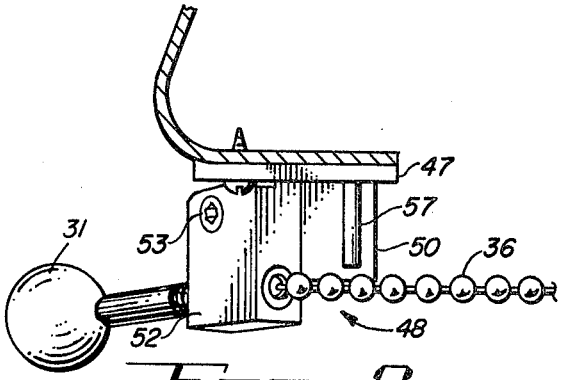
FIG. 8 is a partial perspective side view of the throttle control showing the control in its throttle effecting position.
Figure 9:
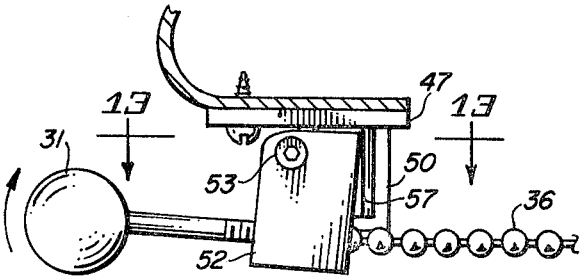
FIG. 9 is a partial perspective side view similar to FIG. 8 showing the throttle control in its throttle released position.

To hold the plate 30 and arm 31 in it most counterclockwise position, the pivotal connection of plate 30 to frame 27 is shown as comprising a rod 39 pivotally mounted in frame 27 at each of its ends and is arranged to extend through an aperture 40 extending through the width of the plate 30 as shown in FIG. 4. A coil spring 41 is mounted around rod 39 and between plate 30 and side 42 of frame 27 as shown. This spring biases plate 30 toward side 43 of the frame causing a pin 44 mounted on side 27A of frame 27 to move into an aperture 45 in side 43 of frame 27 when arm 31 is moved counterclockwise to its most counterclockwise position.

After the arm 31 of the throttle control 20 has been moved to its most counterclockwise position shown in FIG. 4 causing an increase in the idle speed of the engine and being locked in said position by the pin 44 engaging aperture 45 and being held there by spring 41, the throttle may be quickly returned to its original position by merely pushing up on arm 31 against the biasing action of spring 41. The spring tension of the gas peddle will quickly rotate the plate 30 clockwise returning the throttle to its original, normal or carburetor set position.

Thus, the operator of the vehicle may quickly and easily adjust the throttle of the engine to compensate for rough idle due to air compressor loads or cold starting engine problems.

FIGS. 7–13 disclose a modification of the throttle control shown in FIGS. 1–6 wherein like parts are given the same reference characters.

The throttle control 46 shown in FIGS. 7–13 comprises a plate 47 suitable secured to the bottom edge 28 or other suitable place on the dashboard 21 of a vehicle and employs the threaded arm 31 extending through a latch means 48 pivotally connected to plate 47 by a bolt 49 loosely extending through a block or part 50 of the latch or lever means 48 and threaded connected to an aperture 51 in plate 47.

A second block or part 52 is pivotally attached to one side of block 50 in a juxtaposed manner by a pin 53 that loosely extends laterally through an aperture 54 in block 52 and is threadedly connected in an aperture in the juxtaposed side of block 50.

The bottom surface of block 52 is provided with a catch pin 55 which engages with a catch pin hole 56 in plate 47 when the block 52 is rotated clockwise to cause pin 55 of block 52 to engage hole 56 thereby placing tension on the flexible chain 36 to increase the idle speed of the engine.

Figure 10:
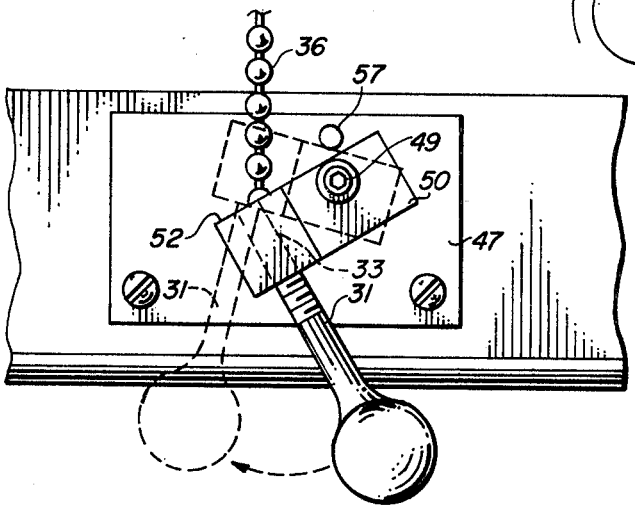
FIG. 10 is a bottom view of FIG. 9 showing the control in dash lines representing the bottom view of FIG. 8.
Figure 12:
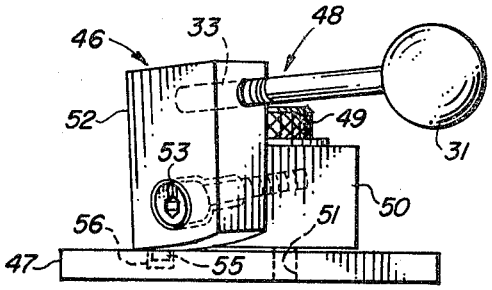
FIG. 12 is a partial perspective inverted view of the throttle control shown in FIGS. 7–11 illustrating the pin locking means and pin catch hole.
Figure 13:
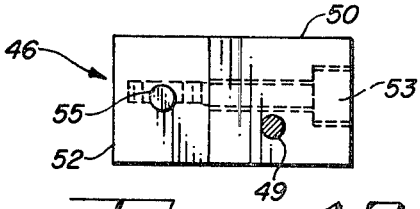
FIG. 13 is a cross sectional view of FIG. 9 taken along the line 13—13.
Figure 11:
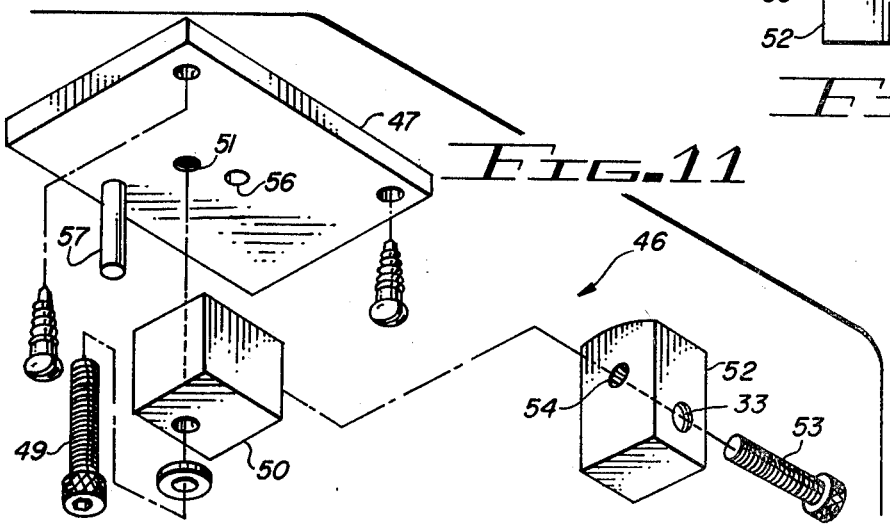
FIG. 11 is an exploded perspective view of the throttle control shown in FIGS. 7–10.

The tension on the flexible chain and on the block causes the pin 55 on block 52 to move into aperture 56 when the latch means 48 comprising blocks 50 and 52 are pivotally moved clockwise as shown in FIG. 10 against a stop 57 extending laterally out of plate 47 into the path of movement of latch means 48.

To release pin 55 from aperture 56, the operator merely pushes shaft 31 toward plate 47 threadedly mounted in block 52 in the manner described for FIGS. 1–6 causing block 52 to pivot relative to block 50. This action lifts pin 55 out of aperture 56 and the spring base of gas peddle 24 on chain 36 biases the latch means 48 counterclockwise as shown in FIG. 10 returning the throttle control 46 and the associated throttle of the engine to its initial position as heretofore explained. In this normal position of the throttle control 46 the latch means 48 may be again stopped in its pivotal movement by stop 57.

Although but a few embodiments of the invention have been illustrated and described, it will be apparent to those skilled in the art that various changes and modifications may be made therein without departing from the spirit of the invention or from the scope of the appended claims.

What is claimed is:

1. A throttle control comprising:

a lever means, a first means for pivotally mounting said lever means on an internal combustion engine driven vehicle at the driver's position, a second means attached to said lever means laterally thereof for use in pivotally moving said lever means, said second means comprising a bolt threadedly attached to said lever means, said bolt upon movement relative to said lever arm forming a vernier adjustment for throttle control of the engine of the vehicle, flexible means for attachment at one end thereof to the acceleration mechanism of the vehicle and at the other end to one end of said second means, catch means mounted on said lever means and detachably connectable with the vehicle whereby when said lever means it pivoted in one direction to move the acceleration mechanism against its biasing means it varies the throttle setting of an engine of the vehicle, and third means for releasing said lever means from the vehicle, said lever means pivoting back to its initial position under the biasing effect of the acceleration mechanism of the vehicle acting through said flexible means.

2. The throttle control set forth in claim 1 wherein:

said first means comprises a frame member for mounting on a dashboard of the vehicle, and a rod pivotally attaching said lever means to said frame member, said catch means detachably engaging said frame member.

3. The throttle control set forth in claim 2 wherein:

said lever means comprises two parts, one of said parts being pivotally attached to said frame member, and the other of said parts being pivotally attached to said first part for movement relative thereto, said other of said parts having said second means and said catch means attached thereto.

4. A throttle control comprising:

a plate for mounting on a dashboard of a vehicle, a lever means, said lever means comprising two parts, one of said parts being pivotally mounted on said plate, the other of said parts being pivotally mounted on one side of said one of said parts, an adjustment means threadedly attached to said other of said parts, an elongated flexible means attached at one end to said adjustment means and attachable at the one end to the acceleration mechanism of the vehicle, said lever means when pivotally movable by grasping said adjustment means and rotating said lever means relative to said plate in a given direction a given distance applying tension to said flexible means to vary the positon of the acceleration mechanism of the vehicle to vary the throttle setting of the associated engine, and catch means mounted on said other of said parts for detachably engaging said plate to hold said latch means when moved said given distance.

5. The throttle control set forth in claim 4 in further combination with:

means for pivotally moving said other of said parts relative to said one of said parts to disengage said catch means from said plate.

6. The throttle control set forth in claim 4 wherein:

said catch means comprises a pin extending laterally from said other of said plates for extending into an aperture in said plate.

7. The throttle control set forth in claim 4 wherein:

said adjustment means comprises a bolt threadedly mounted within an aperture extending laterally through said other of said parts.

8. The throttle control set forth in claim 4 wherein:

said flexible means comprises a flexible chain.

9. The throttle control set forth in claim 4 wherein:

the other end of said adjustment means is provided with a hand gripping surface.

* * * * *